US005909802A

United States Patent [19]

Puco et al.

[11] Patent Number: 5,909,802

[45] Date of Patent: Jun. 8, 1999

[54] VEST BACKPACK

[75] Inventors: Albert Anthony Puco; Carylann Allegra Acito Puco, both of Cherry Valley, N.Y.

[73] Assignee: Albert A. Puco, Cherry Valley, N.Y.

[21] Appl. No.: 08/889,493

[22] Filed: Jul. 8, 1997

[51] Int. Cl.[6] ..... A41D 1/04

[52] U.S. Cl. ..... 2/102; 2/94; 224/148.1; 220/450

[58] Field of Search ..... 2/102, 108, 85, 2/93, 94, 88; 224/148.1, 148.4, 209, 148.3; 220/450, 452, 460, 461, 903; 383/110, 113, 114, 117

[56] References Cited

U.S. PATENT DOCUMENTS

| | | | |
|---|---|---|---|
| D. 316,172 | 4/1991 | Hanson | 2/94 |
| 939,871 | 11/1909 | Sherman | 2/102 |
| 2,085,250 | 4/1937 | Finlay | 2/102 |
| 2,437,223 | 3/1948 | Dutrow | 2/93 |
| 2,620,479 | 12/1952 | Buck | 2/94 |
| 3,085,612 | 4/1963 | Gobel | 224/919 |
| 3,105,241 | 10/1963 | Allen | 2/94 |
| 3,529,307 | 9/1970 | Belson et al. | 2/94 |
| 4,106,121 | 8/1978 | Belson | 2/94 |
| 4,401,245 | 8/1983 | Zills | 224/148.4 |
| 4,871,597 | 10/1989 | Hobson | 224/148.4 |
| 4,884,731 | 12/1989 | Sibley | 224/115 |
| 5,005,374 | 4/1991 | Spitler | 62/259.3 |
| 5,014,359 | 5/1991 | Hanson | 2/94 |
| 5,247,707 | 9/1993 | Parker et al. | 2/102 |
| 5,465,425 | 11/1995 | Crispin | 2/102 |
| 5,497,922 | 3/1996 | Tate | 224/209 |
| 5,673,836 | 10/1997 | Bush | 224/576 |

*Primary Examiner*—Gloria M. Hale
*Attorney, Agent, or Firm*—Richard C. Litman

[57] ABSTRACT

A vest and backpack combination having a hood and a mask. The vest includes several panels sewn together creating an overlapping front opening. The vest is ventilated by a plurality of metal grommets disposed on the surface of the vest. A harness-like belt, adjustable sleeves, and shoulder strap arrangement support detachable load carriers in the front and back of the vest. The arrangement of the belt and shoulder straps result in an even distribution of load weight on the seams, thus promoting durability and facilitating transport of heavier loads. In addition to the main zippered backpack, a number of other, smaller, detachable and permanently attached pouch components are provided for carrying game and camping equipment, food, first aid, and other survival gear. The vest may be stripped of the multiple components and worn as an ordinary vest when so desired.

20 Claims, 6 Drawing Sheets

VEST BACKPACK

BACKGROUND OF THE INVENTION

1. Field of the Invention

The present invention relates to article carriers and, more specifically, to a vest and backpack combination having a hood with a mask and a plurality of detachable load carriers in the front and back of the vest.

2. Description of Related Art

While hiking and enjoying other outdoor activities, it is often useful to carry a plurality of items. These items are often large or numerous, thereby requiring the aid of an article carrier. Backpacks have an important advantage over other article carriers when hiking, because the hands and arms of a hiker are free to swing back and forth, and thus the hiker's manner of walking is unencumbered.

On more extended hikes, equipment requirements increase and a greater load capacity becomes necessary. Auxiliary packs connected to the main backpack increase the load capacity, enabling treks of greater duration. When a large load is carried within a backpack, however, a hiker must lean forward to maintain balance. Backpacks which use a frame and a hip belt, to shift weight from the shoulders to the hips, decrease the degree to which a hiker must lean in order to maintain balance. A frame and hip belt with the addition of a front pack as a counter-balance to a backpack allows a hiker to maintain an upright attitude while walking.

Related art in this field includes the following teachings.

U.S. Pat. No. 4,884,731, issued to Paul T. Sibley on Dec. 5, 1989, shows a backpack with a pair of detachable auxiliary side packs for carrying more articles than can fit in the pack.

U.S. Pat. No. 5,497,922, issued to Aarn Tate on Mar. 12, 1996, shows a backpack having a pair of shoulder straps and a hip suspension system and a pair of detachable front pockets for counter-balancing the weight of the backpack.

Vests have been used as alternative to a frame and hip belt assembly for distributing a load carried within a backpack. The load within the prior art vests is distributed throughout the upper torso by loading a plurality of pockets attached to the front and back of the vest.

U.S. Design Pat. No. 316,172, issued to Hanson shows an ornamental design for a combined vest and backpack and U.S. Design Pat. No. 339,912, issued to Delauter shows an ornamental design for a combined backpack and hood.

U.S. Pat. No. 2,620,479, issued to Lamb G. Buck on Dec. 9, 1952, shows a vest-like sportsman's garment made up of an outer garment having a substantially large pocket provided on the back thereof and a harness carrying a pair of depending pockets.

U.S. Pat. No. 5,465,425, issued to Harold D. Crispin on Nov. 14, 1995, shows a fishing garment with removable pockets disposed on both the front and back thereof.

U.S. Pat. No. 5,014,359, shows a variable load vest and backpack combination having a seat pad.

U.S. Pat. No. 5,247,707, issued to David M. Parker et al., on Sep. 28, 1993, shows a utility vest with an integrally carried pack. A pair of straps are engageable with a belt there transfer the weight of items clipped or otherwise attached to the belt to the shoulders of the user, preventing the belt from riding low or sliding down around the users hips.

However, none of the prior art devices show a vest with a detachable front pack for use as a counter balance to a detachable backpack.

None of the above inventions and patents, taken either singularly or in combination, is seen to describe the instant invention as claimed. Thus a vest backpack solving the aforementioned problems is desired.

SUMMARY OF THE INVENTION

A vest and backpack combination having a hood and a mask and especially adapted for the outdoorsman is provided by the present invention. The vest includes a back panel, a right front panel, and a left front panel sewn together creating an overlapping front opening and a pair of shoulder openings. The vest is ventilated by a plurality of metal grommets disposed on the surface of the vest. A waist belt, midriff belt, adjustable fasteners between the back panel and left and right front panels, and a shoulder strap load equalization arrangement support detachable load carriers in the front and back of the vest. The load support arrangement of the belts and shoulder straps result in an even distribution of load on the seams of the vest and throughout the upper torso of the wearer, thereby promoting durability and facilitating the transport of heavier loads.

In addition to the main zippered backpack with an integral smaller pack, a pair of side packs and a front pack are provided for carrying game and camping equipment, food, first aid, and other survival gear. The vest may be stripped of its multiple components and worn as an ordinary vest if so desired.

Accordingly, it is a principal object of the invention to provide a vest backpack combination having a detachable front pack for use as a counter balance to a detachable backpack.

It is another object of the invention to provide a vest backpack combination having a waist belt, midriff belt, adjustable fasteners between the back panel and left and right front panels, and a shoulder strap load equalization arrangement that supports detachable load carriers in the front and back of the vest and which together distribute the load evenly throughout the upper torso of the wearer.

It is a further object of the invention to provide a pair of insulated water bottle holders that are constructed in layers.

Still another object of the invention is to provide a vest backpack which may be stripped of its multiple components and worn as an ordinary vest if so desired.

It is an object of the invention to provide improved elements and arrangements thereof in a vest backpack for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
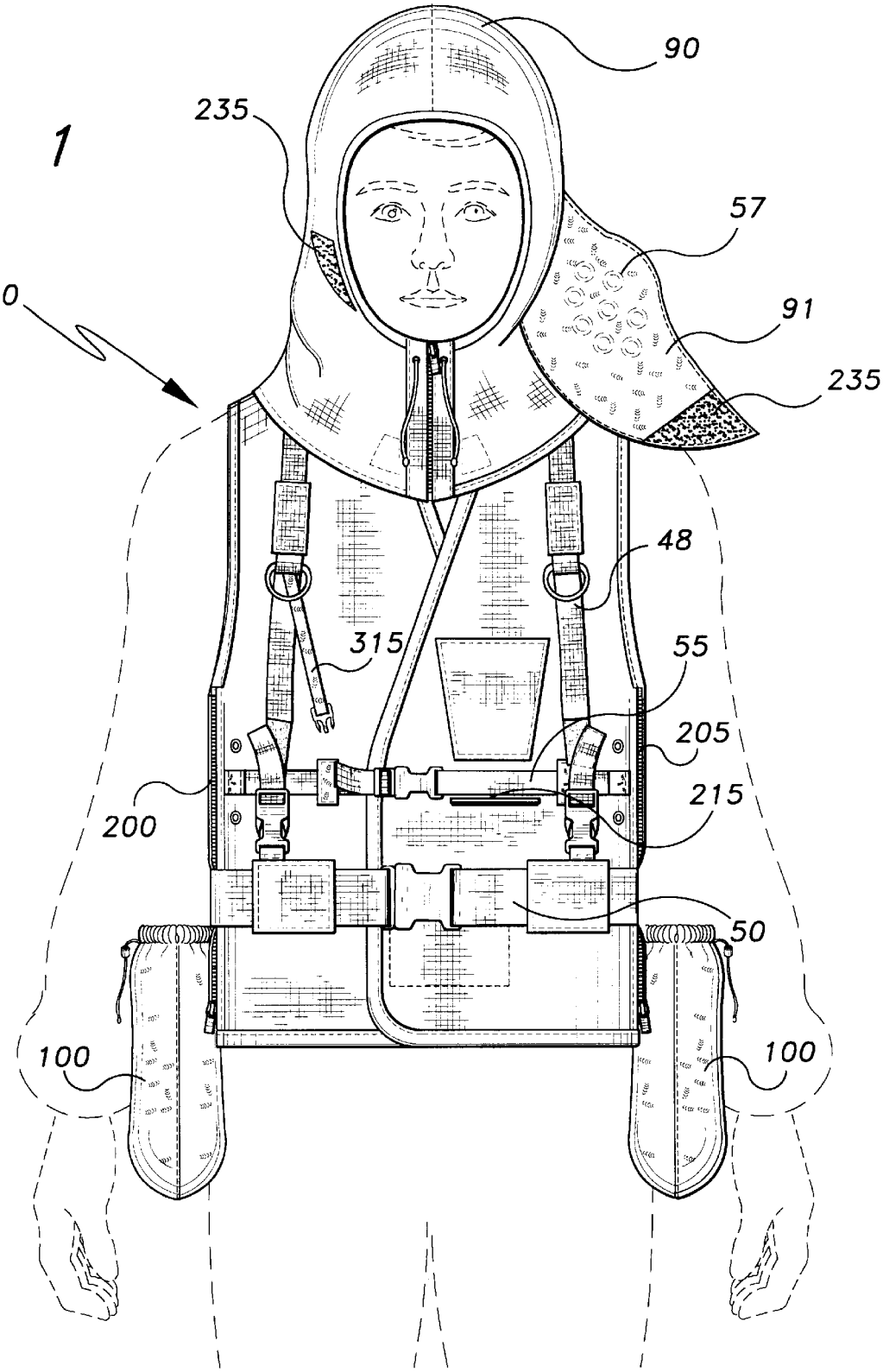
FIG. 1 is a front view of a vest worn by user according to the present invention.

Referring to FIGS. 1–7 and in particular to FIG. 1 thereof, a vest backpack combination embodying the principles and concepts of the present invention and generally designated by the reference numeral 10 will be described.

Figure 2A:
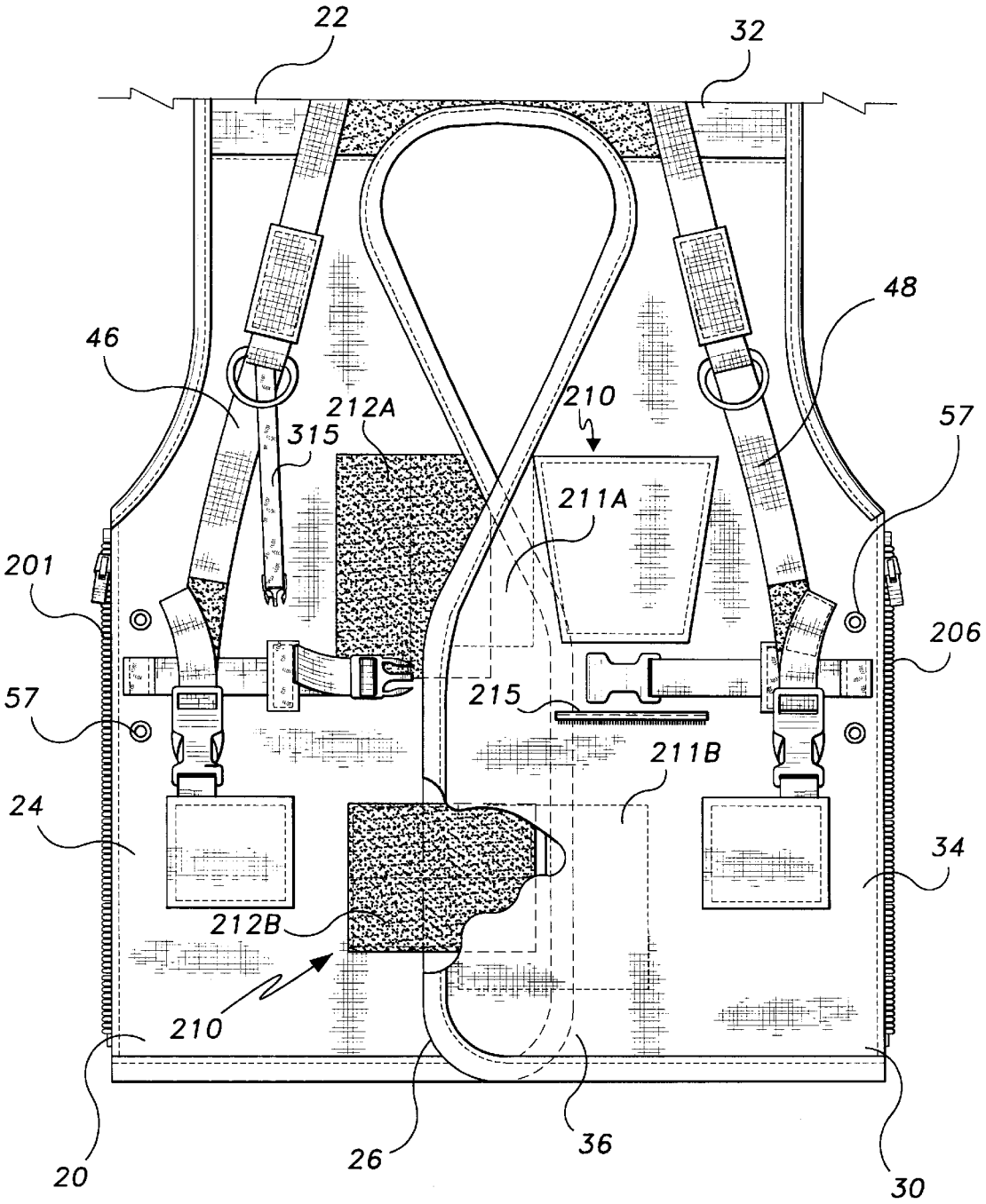
FIG. 2A is a top plan view of the front of the vest.
Figure 2B:
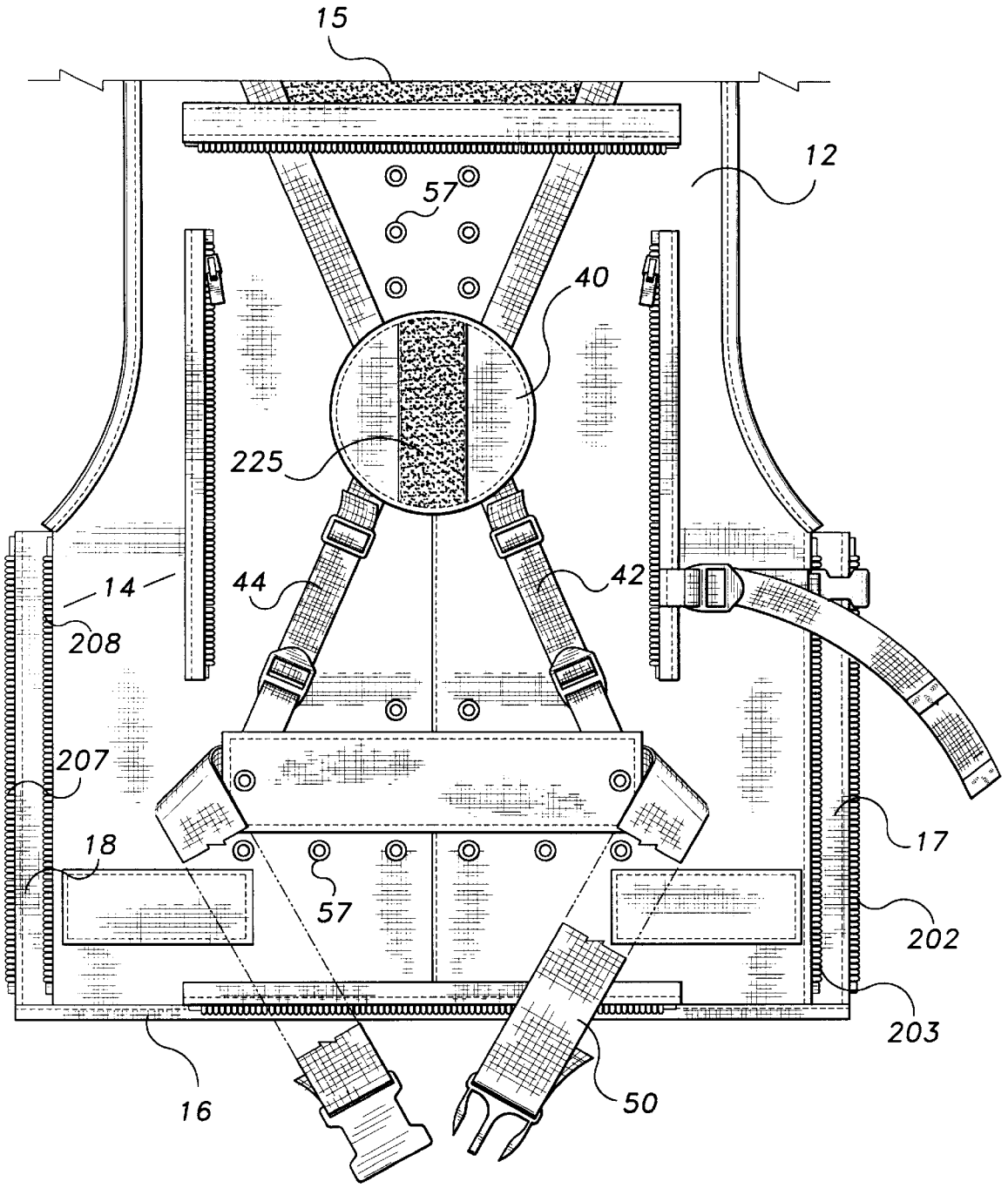
FIG. 2B is a top plan view of the back of the vest.

FIGS. 2*a* and 2*b* show the front and back of the vest portion 11, respectively. The vest portion 11 has a back panel 12 integral with a right front panel 20 and a left front panel 30. The back panel 12 has an outer surface 14, an upper end 15, a lower end 16, a right side 17 and a left side 18. The front right panel 20 has an upper end 22, a right side 24 and a left side 26. The front left panel 30 has an upper end 32, a left side 34 and a right side 36. The upper end 15 of the back panel is sewn to the upper end 22 of the front right panel 20 and the upper end 32 of the left front panel 30.

Figure 4:
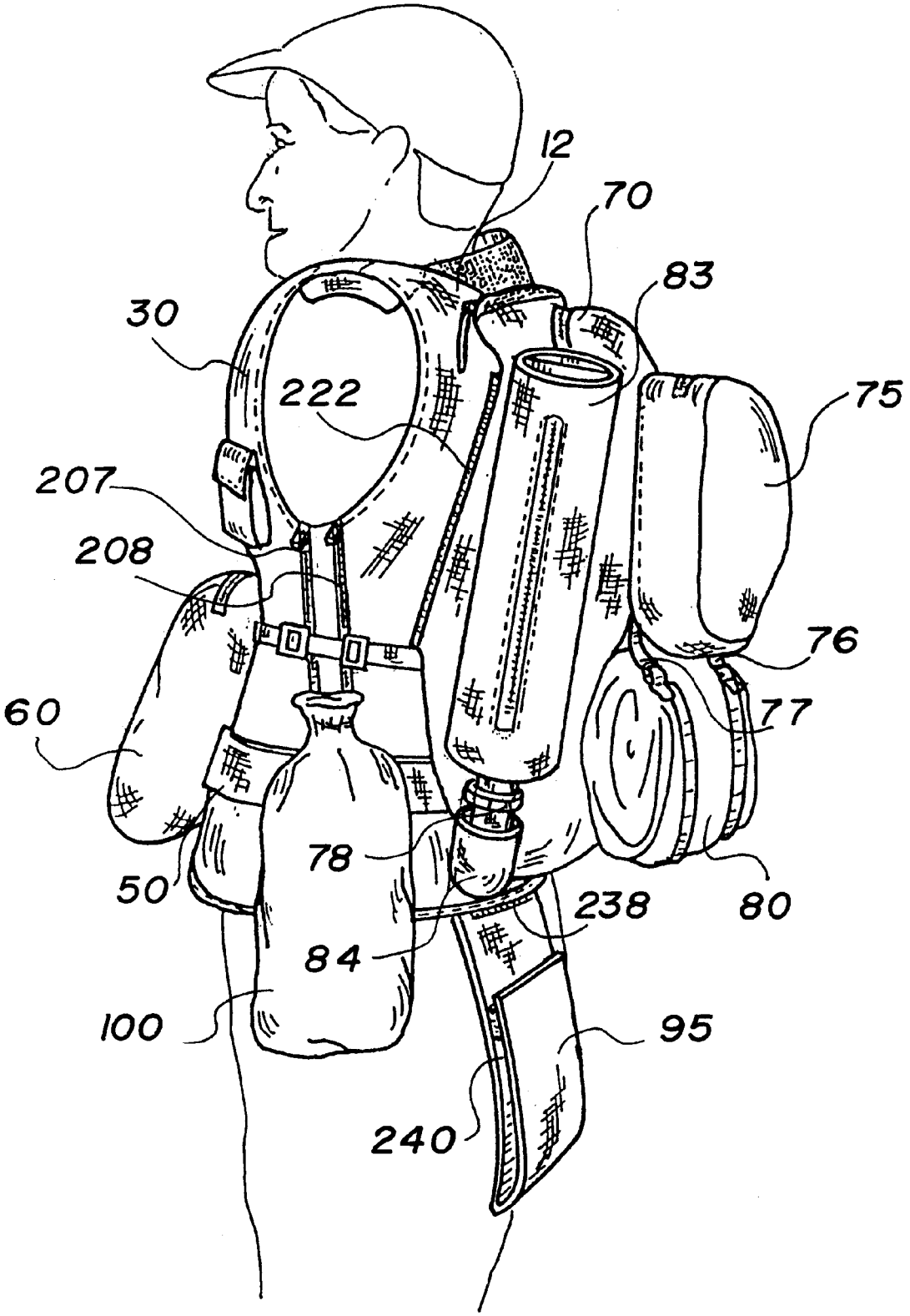
FIG. 4 is a left side assembled view of the vest with backpack and accessories.

Referring to FIGS. 2*a*, 2*b*, and 4, the right side 17 of the back panel 12 is fastened to the right side 24 of the front right panel 20 to define a shoulder opening by a zipper 200. A male portion 201 of the zipper 200 is secured to the right side 24 of the front right panel 20 and a female portion 202 of the zipper 200 is secured to the right side 17 of the back panel 12. Spaced apart from the female portion 202 is a female portion 203 of the zipper 200 which is secured to the right side 17 of the back panel 12. The male portion 201 may be fastened to either the female portion 202 or female portion 203 such that the right side 24 of the right front panel 20 can be fastened to the right side 17 of the back panel 12 in two distinct positions to accommodate clothing layered underneath the vest portion 11 or the absence thereof.

The left side 18 of the back panel 12 is fastened to the left side 34 of the front left panel 30 to define a shoulder opening by a zipper 205. A male portion 206 of the zipper 205 is secured to the left side 34 of the front left panel 30 and a female portion 207 of zipper 205 is secured to the left side 18 of the back panel 12. Spaced apart from the female portion 207 is a female portion 208 of zipper 205 which is secured to the left side 18 of the back panel 12. The male portion 206 may be fastened to either the female portion 207 or female portion 208 such that the left side 34 of the left front panel 30 can be fastened to the left side 34 of the back panel 30 in two distinct positions to accommodate clothing layered underneath the vest portion 11 or the absence thereof.

FIG. 2*a* further shows a hook and loop type fastener 210 which releasably fastens the front right panel 20 to the front left panel 30 in a variety of positions. The hook and loop type fastener 210 includes a pair of first hook type fasteners 211A and 211B sewn to the front right panel 20 and a pair of second loop type fasteners 212A and 212B sewn to the front left panel 30.

With further reference to FIGS. 2*a* and 2*b*, a waist belt 50 and a midriff belt 55 aid in ensuring a that the vest portion 11 is form fitting, distributing any load, placed on the vest portion, evenly throughout the upper torso.

A load equalization member 40 is connected to the vest portion 11 by a first strap 42, a second strap 44, a third strap 46, and a fourth strap 48. The four straps are sewn to and extend from the load equalization member 40 in a radially spaced configuration. The first strap 42 and the second strap 44 are sewn to the right side 17 and the left side 18 of the back panel 12, respectively. The third strap 46 is sewn to the front right panel 20, and the fourth strap 48 is sewn to the front left panel 30.

Referring to FIGS. 1, 2A, 2B, 3, and 5, a plurality of grommets 57 are spaced about the vest portion to provide ventilation.

Figure 3:
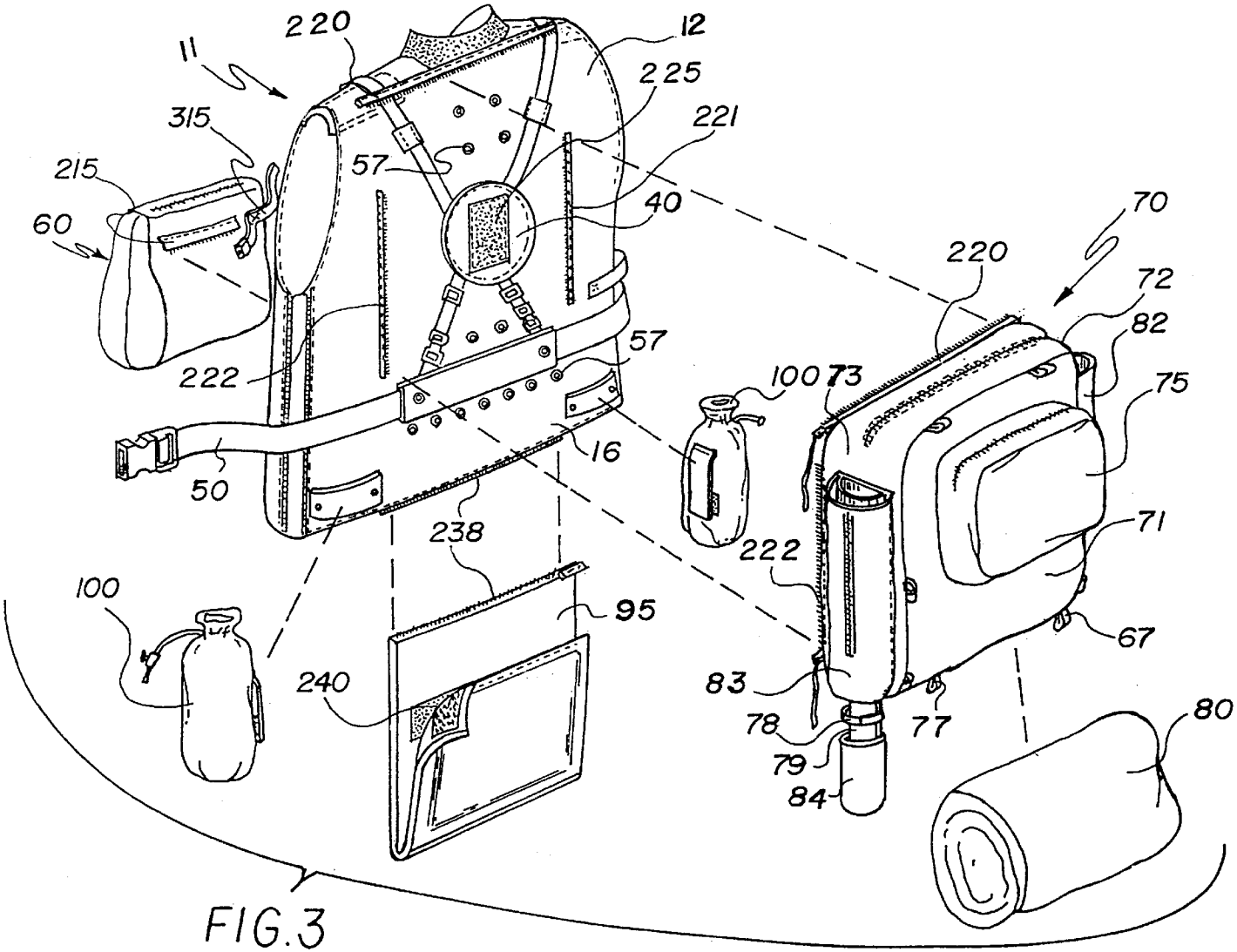
FIG. 3 is a rear exploded view of the vest with accessories.

FIG. 3 discloses a detachable front pack 60 having a plurality of article holders (not shown) therein, which is attached to the left front panel 30 of the vest portion 11 by a zipper 215 and to the third strap 46 by a strap and buckle 315.

A detachable backpack 70, having a back 71, a right side 72 and a left side 73, is releasably attached to the back panel 12 by three zippers 220, 221, 222 and to the load equalization member 40 by a hook and loop type fastener 225. The backpack 70 includes a smaller pack 75 integral with the backpack 70 and disposed on the back 71 thereof. The backpack 70 has a pair of straps 76 and 77 sewn thereto for holding a bed roll 80 or the like. A right side pack 82 and a left side pack 83 are attached to the right side 72 and the left side 73 of the backpack 70, respectively, so as to leave a space between the side packs 82, 83 and the backpack 70 for stowing articles.

The space between the right side pack 82 and the backpack 70 is used for holding a plurality of elongated objects (not shown) such as tent poles. The elongated objects are held in place by a small pocket (not shown) attached to the right side 72 of the backpack 70 at the bottom of the space into which the downward facing ends of the elongated objects are placed.

The space between the left side pack 83 and the backpack 70 may be used as map holding device. Attached to the left side 73 of the backpack 70 is a conical annulus (not shown) for guiding a map into the space, a releasable strap 78 for securing the map 79, and a cylindrical pocket 84 into which the downward facing end of the map is disposed.

Figure 5:
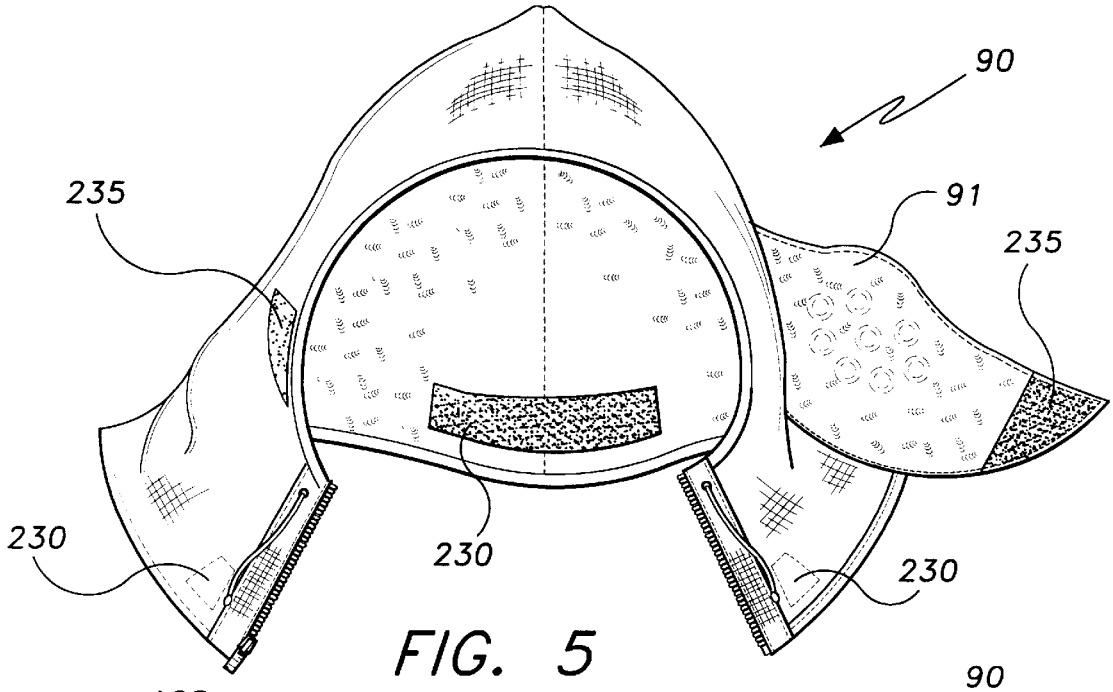
FIG. 5 is a front elevation view of the vest hood.
Figure 7:
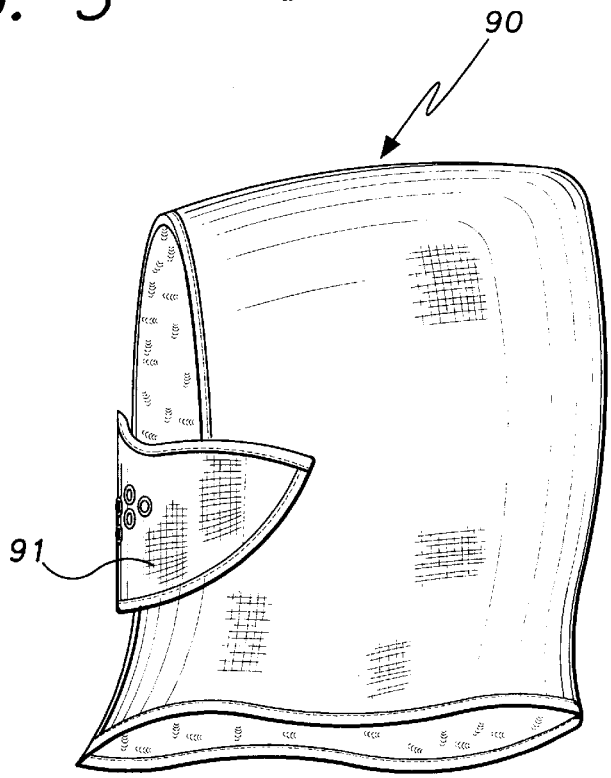
FIG. 7 is a side elevation view of the vest hood.

Referring to FIGS. 5 and 7, a detachable hood 90 is removably connected to the vest portion 11 by a hook and loop type fasteners 230. The detachable hood 90 has a detachable ventilated face mask 91, held in place by a hook and loop type fastener 235.

As seen in FIGS. 3 and 4, a seat pad 95 is releasably attached to the lower end 16 of the back panel 12 by a zipper 238. The seat pad 95 folds up and can be adjusted between a first position during use and a second position during non-use and retained in position using a hook and loop type fastener 240. Also, a pair of insulated water bottle holders 100 are attached to the lower end 16 of the back panel 12.

Figure 6:
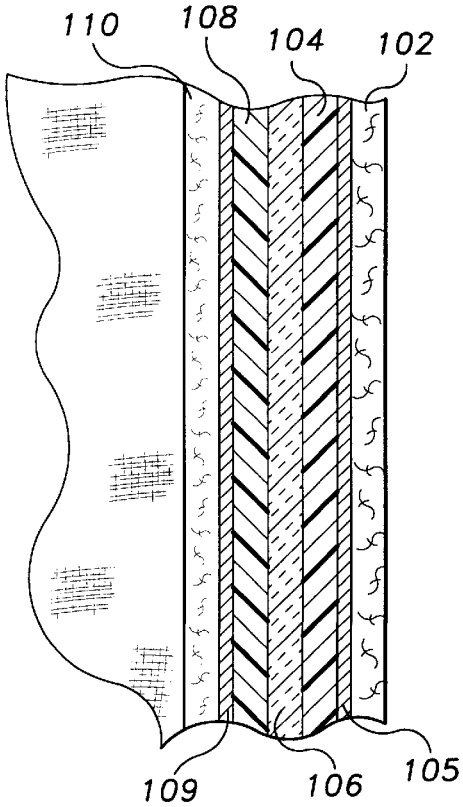
FIG. 6 an cross sectional view of a water bottle carrier according to the present invention.

Referring in particular to FIG. 6, the insulated water bottle holders 100 are shown as being constructed of layers. An outer layer 102 is formed of a durable woven nylon material. A first reflective layer 104 is formed of polyethylene, having a reflective aluminum coated surface 105 adjacent the outer layer. An insulative layer 106 is formed of a fleece material adjacent the first reflective layer 104, the insulative layer 106 being located on the side of the first reflective layer 104 opposite the reflective surface 105.

A second reflective layer 108 is formed of polyethylene, having a reflective aluminum coated surface 109, wherein the second reflective layer 108 is adjacent the insulative layer 106 on the side of the insulative layer 106 opposite the first reflective layer 104. An inner layer 110 is formed of a woven flannel material adjacent the reflective surface 108 of the second reflective layer 108.

It is to be understood that the present invention is not limited to the embodiment described above, but encompasses any and all embodiments within the scope of the following claims.

We claim:

1. A vest backpack combination, comprising:

a vest portion having a back panel integral with a right front panel and a left front panel, said back panel having an outer surface, an upper end, a right side and a left side, said front right panel having an upper end, a right side and a left side, and said front left panel having an upper end, a left side and a right side, said upper end of said back panel being connected to said upper end of said front right panel and said upper end of said left front panel;

first fastening means for fastening said right side of said back panel to said front right panel to define a shoulder opening;

second fastening means for fastening said left side of said back panel to said front left panel to define a shoulder opening;

a load equalization member connected to said vest portion; and a first pack releasably connected to said back panel and said load equalization member.

2. The vest backpack combination according to claim 1, there further being a plurality of connection straps, said load equalization member being connected to said vest portion by said plurality of straps.

3. The vest backpack combination according to claim 2, wherein said plurality of straps comprises at least four straps extending from said load equalization member in a radially spaced configuration, two of said at least four traps being connected to said back panel, another of said at least four straps being connected to said front right panel, and yet another of said at least four straps being connected to said front left panel.

4. The vest backpack combination according to claim 1, further comprising third fastening means for releasably fastening said front right panel to said front left panel in a predetermined variety of positions.

5. The vest backpack combination according to claim 4, wherein said third fastening means comprise detachable, interengaging hook and loop fastener means.

6. The vest backpack combination according to claim 1, wherein said first fastening means comprise:

a first cooperating fastener secured to said right side of said front right panel; and a second cooperating fastener secured to said right side of said back panel, said second cooperating fastener being disposed to engage said first cooperating fastener.

7. The vest backpack combination according to claim 6, wherein said first fastening means further comprise a third fastener secured to said right side of said back panel in spaced relation to said second cooperating fastener, said third fastener being disposed to engage said first cooperating fastener.

8. The vest backpack combination according to claim 1, wherein said second fastening means comprise:

a fourth fastener secured to said left side of said front left panel; and a fifth fastener secured to said left side of said back panel, said fifth fastener being disposed to engage said fourth fastener.

9. The vest backpack combination according to claim 8, wherein said second fastening means further comprises a sixth fastener secured to said left side of said back panel in spaced relation to said fifth fastener, said sixth fastener being disposed to engage said fourth fastener.

10. The vest backpack combination according to claim 1, further comprising a second pack releasably connected to a selected one of said front panels.

11. The vest backpack combination according to claim 1, further comprising a detachable hood removably connected to said vest portion, said detachable hood having a detachable ventilated face mask.

12. The vest backpack combination according to claim 1, further comprising at least one insulated water bottle holder removably attached to said vest portion, said at least one insulated bottle holder having a bottle removably stored therein.

13. The vest backpack combination according to claim 1, further comprising a seat pad releasably attached to said back panel, and adjustable between a first position during use and a second position during non-use.

14. The vest backpack combination according to claim 1, further comprising a plurality of ventilation means spaced about said vest portion.

15. A vest backpack combination, comprising:

a vest portion having a back panel integral with a right front panel and a left front panel, said back panel having an outer surface, an upper end, a right side and a left side, said front right panel having an upper end, a right side and a left side, and said front left panel having an upper end, a left side and a right side, said upper end of said back panel being connected to said upper end of said front right panel and said upper end of said left front panel;

first fastening means for fastening said right side of said back panel to said front right panel to define a shoulder opening, said first fastening means including a first fastener secured to said right side of said front right panel and a second fastener secured to said right side of said back panel, said second fastener being disposed to engage said first fastener, said first fastening means further including a third fastener secured to said right side of said back panel in spaced relation to said second fastener, said third fastener being disposed to engage said first fastener;

second fastening means for fastening said left side of said back panel to said front left panel to define a shoulder opening, said second fastening means including a fourth fastener secured to said left side of said front left panel and a fifth fastener secured to said left side of said back panel, said fifth fastener being disposed to engage said fourth fastener, said second fastening means further including an sixth fastener secured to said left side of said back panel in spaced relation to said fifth fastener, said sixth fastener being disposed to engage said fourth fastener;

third fastening means for releasably fastening said front right panel to said front left panel in a predetermined variety of positions, said third fastening means including a seventh fastener connected to said front right panel and an eighth fastener connected to said front left panel, said seventh fastener being disposed to matingly engage said eighth fastener, said seventh and eighth fasteners being hook and loop type fasteners;

a load equalization member and a plurality of straps for connecting said load equalization member to said vest member, wherein said plurality of straps comprises at least four straps extending from said load equalization member in a radially spaced configuration, two of said four straps being connected to said back panel, another of said four straps being connected to said front right panel, and yet another of said four straps being connected to said front left panel;

a first pack releasably connected to said back panel and said load equalization member;

a second pack releasably connected to one of said front panels;

a detachable hood removably connected to said vest portion, said detachable hood having a detachable ventilated face mask;

a seat pad releasably attached to said back panel, and adjustable between a first position during use and a second position during non-use; and a plurality of ventilation means spaced about said vest portion; and an insulated water bottle holder, comprising:

an outer layer formed of a durable woven nylon material;

a first reflective layer formed of polyethylene, and having a reflective aluminum coated surface adjacent said outer layer;

an insulative layer formed of a fleece material selected from the group consisting of woven and non-woven fleece adjacent said first reflective layer, said insulative layer being located on the side of said first reflective layer opposite said reflective surface;

a second reflective layer formed of polyethylene, and having a reflective aluminum coated surface, wherein said second reflective layer is adjacent said insulative layer on the side of said insulative layer opposite said first reflective layer; and an inner layer formed of a woven flannel material, said inner layer being located adjacent said reflective surface of said second reflective layer.

16. An insulated water bottle holder, comprising:

an outer layer with a first reflective layer having a reflective surface adjacent said outer layer;

an insulative layer adjacent said first reflective layer, and located on the side of said first reflective layer opposite said reflective surface;

a second reflective layer having a reflective surface, and being adjacent said insulative layer on the side of said insulative layer opposite said first reflective layer; and an inner layer adjacent said reflective surface of said second reflective layer.

17. The insulated water bottle holder according to claim 16, wherein said first reflective layer and said second reflective layer are fabricated from polyethylene, and said reflective surface on each said reflective layer is a metal coating.

18. The insulated water bottle holder according to claim 16, wherein said insulative layer is formed of a fleece material selected from the group consisting of woven and non-woven fleece.

19. The insulative water bottle holder according to claim 16, wherein said outer layer is formed of a woven nylon material.

20. The insulative water bottle holder according to claim 16, wherein said inner layer is formed of a woven flannel material.

* * * * *